US009694250B2

(12) United States Patent
Egerton

(10) Patent No.: US 9,694,250 B2
(45) Date of Patent: Jul. 4, 2017

(54) LACROSSE BALL CONTAINER AND RESURFACER

(71) Applicant: James Mckenny Egerton, Middletown, DE (US)

(72) Inventor: James Mckenny Egerton, Middletown, DE (US)

( * ) Notice: Subject to any disclaimer, the term of this patent is extended or adjusted under 35 U.S.C. 154(b) by 4 days.

(21) Appl. No.: 14/683,570

(22) Filed: Apr. 10, 2015

(65) Prior Publication Data

US 2015/0297956 A1 Oct. 22, 2015

Related U.S. Application Data

(60) Provisional application No. 61/980,759, filed on Apr. 17, 2014.

(51) Int. Cl.

| | |
|---|---|
| ***A63B 47/04*** | (2006.01) |
| ***B65D 81/18*** | (2006.01) |
| ***A63B 71/00*** | (2006.01) |
| *A63B 102/14* | (2015.01) |

(52) U.S. Cl.

CPC ..... *A63B 47/04* (2013.01); *A63B 71/0045* (2013.01); *A63B 2102/14* (2015.10); *A63B 2209/00* (2013.01); *A63B 2225/30* (2013.01)

(58) Field of Classification Search

CPC ..... B24B 11/00; B24B 11/02; B24B 11/06; A63B 47/04; A63B 2047/046

See application file for complete search history.

(56) References Cited

U.S. PATENT DOCUMENTS

| | | | | | |
|---|---|---|---|---|---|
| 2,012,283 | A * | 8/1935 | Miller | A63B 39/025 | 446/220 |
| 3,378,873 | A * | 4/1968 | Strout | A63B 47/04 | 15/104.92 |
| 3,806,983 | A * | 4/1974 | Cunningham | A63B 47/04 | 15/104.94 |
| 4,750,232 | A * | 6/1988 | Doney | A63B 47/04 | 15/104.92 |
| 5,555,586 | A * | 9/1996 | Dorrich | A63B 47/04 | 15/104.92 |
| 5,829,086 | A * | 11/1998 | Billek | A63B 47/04 | 15/104.92 |
| 5,848,690 | A * | 12/1998 | Granger | B65D 81/2053 | 206/315.9 |

(Continued)

OTHER PUBLICATIONS

"Sports Ball Size Comparison." TopendSports.com. May 2, 2016. <http://www.topendsports.com/resources/equipment-ball-size.htm>.*

(Continued)

*Primary Examiner* — Joseph J Hail
*Assistant Examiner* — Joel Crandall
(74) *Attorney, Agent, or Firm* — Marin Patents LP; Gustavo Marin

(57) ABSTRACT

A sports ball container suitable for resurfacing, storing, and carrying sports balls by abrading a surface of one or more sports balls by applying a reciprocating motion. The ball container includes a bottom wall, a cylindrical side, an open end top portion with screw threads thereon, and a cap. The inner surface of the cylindrical side wall is an abrasive surface configured to abrade one or more balls. A lanyard attached to the top portion of the container may be used for the efficient and convenient transportation and storage of sports balls.

4 Claims, 4 Drawing Sheets

(56) References Cited

U.S. PATENT DOCUMENTS

| | | | | |
|---|---|---|---|---|
| 7,892,073 | B1 | 2/2011 | Smania | |
| 8,550,882 | B2 | 10/2013 | Shim | |
| 8,904,593 | B2 * | 12/2014 | Hollows | A63B 47/04 15/104.93 |
| 2003/0121115 | A1 * | 7/2003 | Calabrese | A63B 47/04 15/97.1 |
| 2005/0188482 | A1 * | 9/2005 | Matthews | A63B 47/04 15/21.2 |
| 2012/0329367 | A1 * | 12/2012 | Fitchett | A63B 37/0022 451/5 |

OTHER PUBLICATIONS

Lacrosse: Ball Resurfacing (Easy). Jul. 7, 2012. YouTube. <https://www.youtube.com/watch?v=IJGFBINNtWs>.*

2011 Tennis Ball Specifications. 2011. USTA. <https://www.usta.com/2011_tennis_ball_specifications/>.*

* cited by examiner

LACROSSE BALL CONTAINER AND RESURFACER

CROSS-REFERENCE TO RELATED APPLICATIONS

This application claims priority to U.S. provisional patent application Ser. No. 61/980,759 titled "LACROSSE BALL CYLINDER", filed on Apr. 17, 2014, the entire specification of which is incorporated herein by reference.

BACKGROUND OF THE INVENTION

Field of the Art

The disclosure relates to the field of renewing, transporting, and storing sporting equipment, and more particularly to the field of maintaining, renewing, storing and transporting sports balls.

Discussion of the State of the Art

Sports balls eventually lose their initial rubber grip when they are introduced to the deteriorating elements of time, weather, and regular lacrosse ball usage. As the lacrosse balls lose their initial grip, the lacrosse ball no longer reacts in a predictable way to a lacrosse players' pass or shot in a lacrosse game. Instead of gripping to the lacrosse players' mesh (netting of the lacrosse head), it releases earlier, causing the ball to fly in a direction that may not intended by the player depriving the player of amusement. Typically, players discard used balls and purchase new balls, which becomes costly.

An additional problem is individual lacrosse players do not have a convenient way to transport their lacrosse balls from place to place. Traditionally, lacrosse balls are transported by a large bucket for team usage, containing enough balls for a multitude of players. The individual lacrosse player typically carries her own lacrosse balls by hand or in her pockets due to the smaller quantity. This can be difficult and inconvenient for the lacrosse player if her hands are already occupied or if she doesn't have available pockets.

What is needed is a cost effective apparatus for renewing used lacrosse balls, providing a convenient way of transporting lacrosse balls from place to place, and a convenient way of storing lacrosse balls.

SUMMARY OF THE INVENTION

Accordingly, the inventor has conceived and reduced to practice, in a preferred embodiment of the invention, a lacrosse ball container with a rough inner lining with a resealable cap that can refurbish old lacrosse balls by a reciprocal shaking motion provided by the user. The shaking combined with the abrasive surface will shave off the outer layer of the lacrosse ball creating a new layer of rubber that restores the ball to a grip that it may once have had as a new ball. IN a preferred embodiment, the container will also provide a convenient way of transportation for a small quantity of lacrosse balls by allowing for attachment to a lacrosse stick through the use of a lanyard that will slip over a user's lacrosse shaft.

In a preferred embodiment, the container will be lined with an abrasive material such as sandpaper or glasspaper and will have enough room for at least three lacrosse balls. It will have a twist off cap that can be removed to allow lacrosse balls to enter and leave the container. The cap may have a lanyard attached to it to allow the container to be conveniently slipped onto sporting equipment, for example, the shaft of a lacrosse stick.

According to a preferred embodiment of the invention, a sports ball container suitable for resurfacing, storing, and carrying sports balls by abrading a surface of one or more sports balls is disclosed.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary, and are not to be considered as limiting of the scope of the invention or the claims herein in any way.

DETAILED DESCRIPTION

The inventor has conceived, and reduced to practice, an apparatus for the storage, transportation and resurfacing of lacrosse balls.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Figure 1:
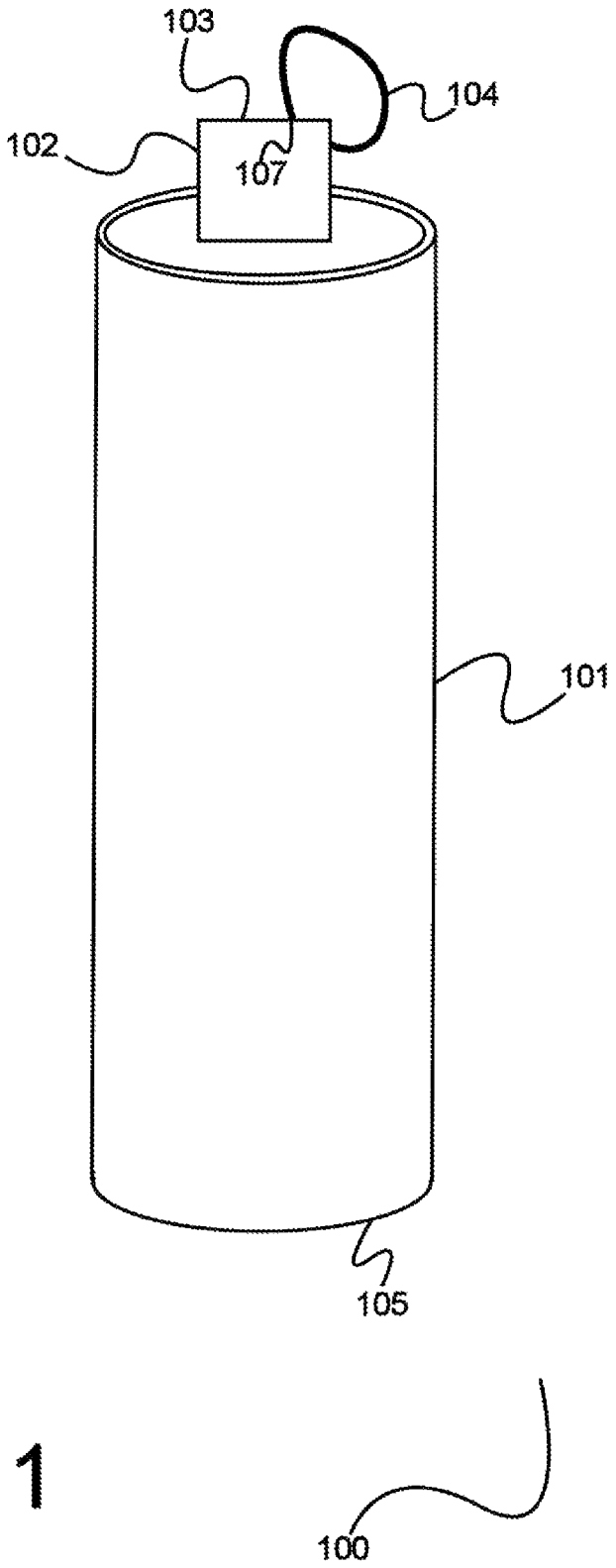
FIG. 1 is an illustration of an exemplary configuration of a fully assembled lacrosse ball container.
Figure 3:
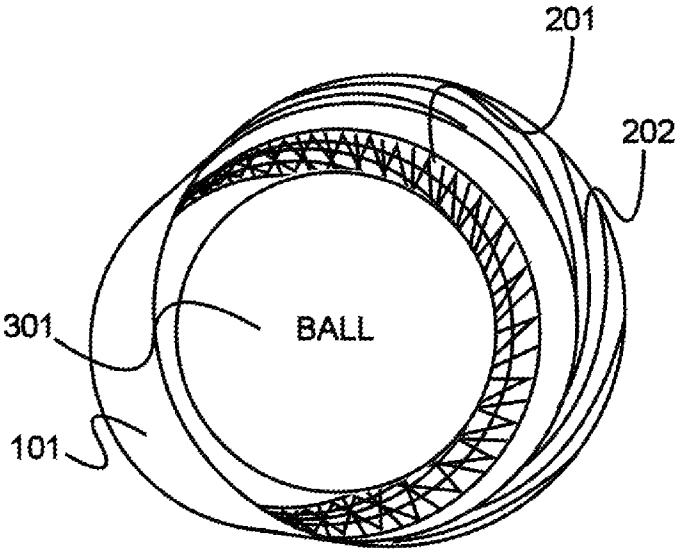
FIG. 3 is an illustration of a top view of a lacrosse ball container with a ball inserted therein.
Figure 2:
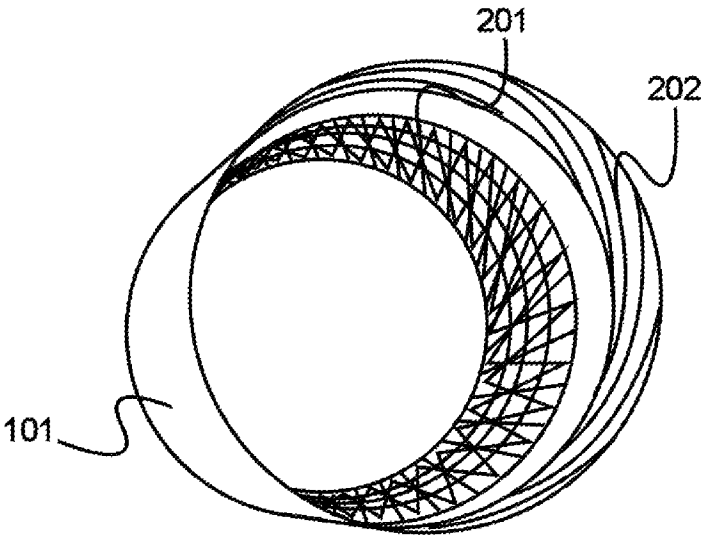
FIG. 2 is an illustration of an inside view of a lacrosse ball container

FIG. 1 is an illustration of an exemplary configuration of a fully assembled lacrosse ball container. Container 100 includes a bottom 105 wall 101, and removable cap 102 and is suitable for abrading the surface to an athletic ball 301 (as shown in FIG. 3), for example, a lacrosse ball, where a smooth surface may be undesirable. Where smooth sports balls such as lacrosse balls are typically discarded once they are worn out, by abrading an expired ball with container 100, the ball may be given an increased longevity and may continue to be used with the same or similar performance as a new ball. In a preferred embodiment, walls 101 of container 100 is a cylindrical shape; however, it should be appreciated that container 100 may have any suitable shape, for example, frustoconical, a hexagonal prism, a rectangular prism, or any other shape that accommodates the movement of a sports ball when inserted into container 100 by applying a reciprocating movement of container 101, by for example, a reciprocal shaking motion by a hand of a user, such that sports ball 301 (as shown in FIG. 3) collides with abrasive interior surface 201 (as shown in FIG. 2) resulting in an abraded exterior of the ball approximating the surface of an unused ball.

In a preferred embodiment, container 100 is preferably between 65 mm and 100 mm in diameter and is ergonomically formed to be easily held in at least one hand of the user. In some embodiments, container wall 101 may be wrapped in a material (for example, neoprene, sports tape such as hockey tape, tennis racket grip or tape, or the like) for increased comfort and/or functionality, for example, by means of increased friction, for more efficient gripping by the user.

In a preferred embodiment, container 100 is preferably between 15 cm to 47 cm in length and is ergonomically formed to be easily held in at least one hand of the user.

In a preferred embodiment, container 100 may be constructed of a synthetic plastic polymer, for example, polyvinyl chloride (PVC), polyethylene, polypropylene, etc. In other embodiments, container 100 may be constructed of aluminum, acrylonitrile butadiene styrene plastic, polylactic acid plastic, polyamide (nylon), glass filled polyamide, stereolithography materials (such as epoxy resins), titanium, steel, polycarbonate, etc., or a combination of one or more of these materials.

Cap 102 is a removable threaded twistable top that may be inserted into the open end of the top portion of container wall 101 using a turning motion. Threaded portion 202 (of FIG. 2) is the top portion of the inner surface of wall 101 such that cap 102 may be engaged to wall 101. In a preferred embodiment, cap 102 comprises male threading while threaded portion 202 (of FIG. 2) of the inner surface of wall 101 is female threaded. In another embodiment, cap 102 comprises female threading while threaded portion 202 (of FIG. 2) of the inner surface of wall 101 is male threaded.

In another embodiment, the diameter of cap 102 is slightly larger than the diameter of the opening of container 100 and is constructed of an elastomeric material, for example rubber, polyurethane elastomeric alloy, silicone, latex, etc. In this regard, cap 102 may not be threaded but rather inserted by means of a user physically forcing cap 102 into the top opening of container 100 such that the elastomeric nature of the material of cap 102 may be flexed to form a seal and keep cap 102 engaged within the container until removed by a user by, for example, the user pulling on lanyard 104 or raised portion 103 to disengage cap 102 from container 100.

In another embodiment, cap 102 has a top wall and a generally cylindrical side wall wherein the side wall of cap 102 has inner and outer surfaces and a bottom edge, where the inner surface of the side wall of cap 102 has screw threads thereon which are engageable with male threads 202 (from FIG. 2) on the top portion of the outside of container 100.

In a preferred embodiment, cap 102 has a raised portion 103 housing hole 107 wherein hole 107 may accommodate lanyard 104. Lanyard 104 may be a rope, cord, twine, string, zip tie, cable tie, keychain chain, key ring, etc. preferably connected as a loop in order to allow for the insertion of sport stick, for example, a lacrosse stick, through lanyard 104. In some embodiments, a more than one lanyard 104 may be attached through hole 107, Depending on the size of the loop, many sizes of sports equipment may be accommodated. It can be appreciated by one with ordinary skill in the art that by attaching container 100 in this manner, the need to carry sports balls in the pockets or in the hands of a user is not necessary and creates a more convenient and pleasurable journey to, for example, a sports venue. Lanyard 104 may also allow container 100 to be hung on a hook, for example, a coat hook or other hanging mechanism, as a storage means, so that balls do not get mislaid and are always present with sporting equipment. It can be appreciated by one with ordinary skill in the art that having balls in close proximity to sporting equipment reduces pre-game stress (for example, by not having to look for balls) and may potentially increase user performance as a result.

FIG. 2 is an illustration of an inside view of a lacrosse ball container. Female threading 202 allows the engagement of cap 102 by means of mating male thread 401 (of FIG. 4) of cap 102 to female threading 202 of wall 101. In some embodiments a hermetic seal may formed by cap 102 and wall 101 thereby not permitting the passage of air or liquid. Abrasive surface 201 provides the means to resurface sports ball 301 (of FIG. 3), for example, a lacrosse ball. In a preferred embodiment, abrasive surface 201 is an attached coated abrasive that consists of a heavy paper with abrasive material attached to its surface (for example, sand paper, glass paper, or other abrasives) and is affixed to the inner surface of cylindrical side 101 of container 100. In other embodiments, different grit sizes may be used for the abrasive material. It can be appreciated by one with ordinary skill in the art that different levels of abrasion may be required for the resurfacing of different sports balls. In another embodiment, the abrasive material is removable to allow different grits of abrasion to be interchanged to impact the speed or level of abrasion. In other embodiments abrasive surface 201 may be formed thereon from a suitable material, such as industrial diamond, pumice, or emery. In another embodiment, abrasive surface 201 may be cast, forged, or machined to be integral with the inner surface of wall 101. In this regard, any abrasive material suitable for resurfacing a sports ball may be used, and such materials should be considered within the scope of the present disclosure.

FIG. 3 is an illustration of a top view of a lacrosse ball container with a ball inserted therein. To resurface one or more balls 301, for example lacrosse balls, a user inserts one or more balls 301 into the opening of container 100 in an open uncapped portion of wall 101. Cap 102 is then mated to wall 101 to create a sealed container 100. The user may then create a reciprocal shaking motion using, for example, her hand while griping container 100. The resulting movement of container 100 causes one or more balls 301 to quickly strike abrasive surface 201 repeatedly causing the surface of one or more balls 301 to be abraded and thereby creating a new surface that has not been exposed to the elements, weather, or sports play. The user may them remove one or more balls 301 and use the resurfaced one or more balls 301 for sports play or amusement.

Figure 4:
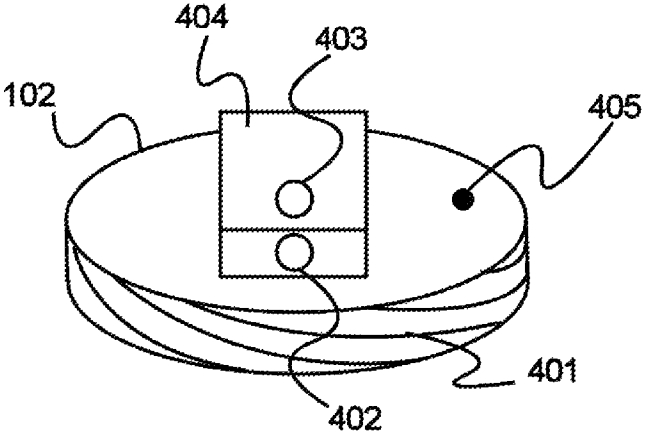
FIG. 4 is an illustration of a lacrosse ball container cap.

FIG. 4 is an illustration of a lacrosse ball container cap. In a preferred embodiment cap 102 is a removable threaded twistable top that may be mated into the open end threaded top portion 202 of container wall 101 using a turning motion by a user into threaded portion 202. In a preferred embodiment, cap 102 comprises male threading 401 while threaded portion 202 of the inner surface of wall 101 is female threaded. In another embodiment, cap 102 comprises female threading 401 while threaded portion 202 of the inner surface of wall 101 is male threaded. In a preferred embodiment, cap 102 may have a raised portion 404 housing a hole 107 that begins at hole entrance 403 and exits at hole exit 402 wherein hole 107 may accommodate lanyard 104. Lanyard 104 may be a rope, cord, twine, string, zip tie, cable tie, keychain chain, key ring, etc. preferably connected as a loop in order to allow for the insertion of sport stick, for example, a lacrosse stick, through lanyard 104. Depending on the size of the loop of lanyard 104, many sizes of sports equipment may be inserted. It can be appreciated by one with ordinary skill in the art that by attaching container 100 in this manner, the need to carry sports balls in the pockets or in the hands of a user is not necessary and creates a more convenient and pleasurable journey to, for example, a sports venue. Lanyard 104 may also allow container 100 to be hung on a hook, for example, a coat hook or other hanging mechanism, as a storage means, so that balls do not get lost and are always present with sporting equipment. It can be appreciated by one with ordinary skill in the art that having balls in close proximity to sporting equipment reduces pre-game stress (for example, by not having to look for balls) and may potentially increase user performance as a result.

In a preferred embodiment, pressure hole 405 may provide pressure release to ease the movement of one or more balls 301 while container 100 is in motion (i.e. in use). In another embodiment, pressure hole 405 may be used to inject air pressure into container 100 to pressurize the container (for example, with air or gas), to maintain an internal pressure in container 100 to store one or more sports balls 301 under pressure, for example, to increase the longevity of sports balls. In this regard, a membrane seal (not shown) may be present in pressure hole 405 to allow compression to be added and be maintained within container 100. It can be appreciated by one with ordinary skill in the art that since sports balls are manufactured with a pressurized core, pressurized gas will leak through the core and thus reduce the efficacy of the sports balls. In this embodiment, the pressure inside of container 100 may be set to approximately the same pressure as the pressure inside of the one or more balls 301 to be contained while in storage, thus reducing gas leakage through the core and increasing the longevity of one or more balls 301.

In another embodiment, the diameter of cap 102 is slightly larger than the diameter of the opening of container 100 and is constructed of an elastomeric material, for example rubber, polyurethane elastomeric alloy, silicone, latex, etc. In this regard, cap 102 may be inserted by means of a user physically forcing cap 102 into the top opening of container 100 such that the elastomeric nature of the material of cap 102 may be flexed to form a seal and keep cap 102 engaged within the container until removed by a user by, for example, the user pulling on lanyard 104 or raised portion 103 to disengage cap 102 from container 100.

Figure 5:
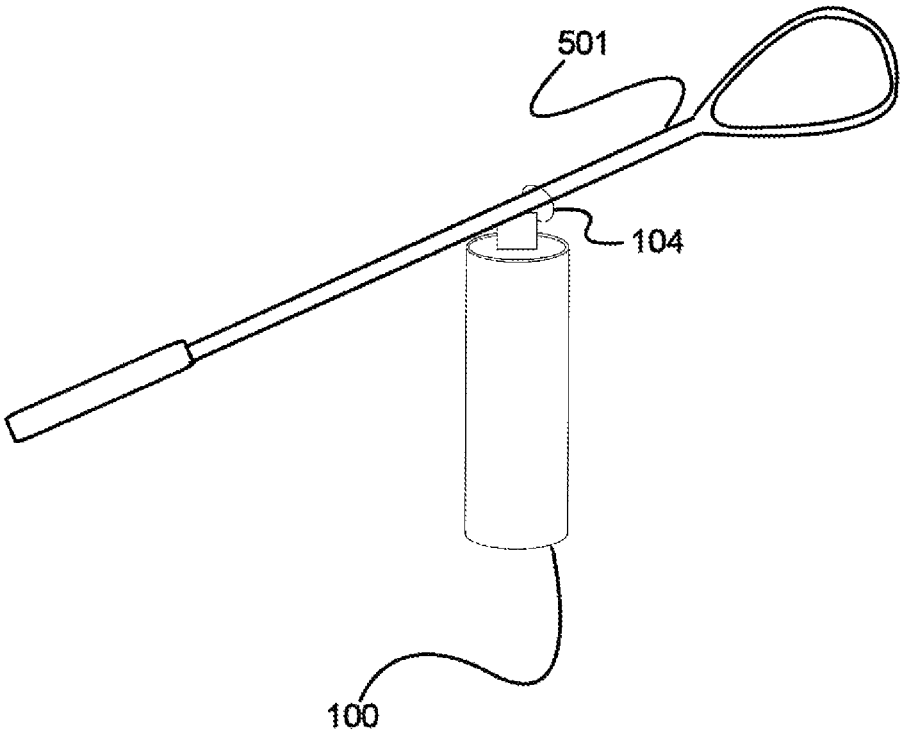
FIG. 5 is an illustration of an exemplary embodiment of a lacrosse ball container mounted onto a lacrosse stick.

FIG. 5 is an illustration of an exemplary embodiment of a lacrosse ball container mounted onto a lacrosse stick. Lanyard 104 may be a rope, cord, twine, string, zip tie, cable tie, keychain chain, key ring, etc. preferably connected in a loop formation to allow for the insertion of sport stick, for example, lacrosse stick 501. In this regard, since the loop in lanyard 104 is narrower than the head of the lacrosse stick, a user carrying the lacrosse can carry both the lacrosse stick and container 100 with one hand without container 100 sliding off the end of lacrosse stick 501. In can be appreciated by one with ordinary skill in the art that such a method of carrying sports equipment would be convenient and enjoyable.

While the above descriptions contain many specificities, these should not be construed as limitations on the scope of the instant invention, but rather as an exemplification of several possible embodiments of the principles thereof. Accordingly, the scope of the instant invention should be determined not by the embodiments illustrated, but by the appended claims and their legal equivalents.

What is claimed is:

1. A ball container assembly comprising:

a container having a bottom wall;

a cylindrical side wall having an upper edge portion which includes inner and outer surfaces and a top edge, wherein a top portion of the inner surface of the cylindrical side wall has screw threads thereon;

an open top end;

a cap having a top and bottom surface and a generally cylindrical side wall having an outer surface, the outer surface of the side wall of the cap having screw threads thereon which are engageable with the screw threads of the container;

wherein the inner surface of the cylindrical side wall is an abrasive surface, the abrasive surface configured to resurface one or more balls;

wherein the abrasive surface is integrally cast or molded to the inner surface;

wherein the diameter of the cylindrical side of the ball container is between 80 mm and 100 mm;

wherein the cap has a pressure release hole to ease movement of the one or more balls.

2. The ball container of claim 1 wherein a top wall has an attached raised portion and a hole extending therethrough, wherein a lanyard is connected through the hole.

3. The ball container of claim 1 wherein the length is between 15 cm and 47 cm.

4. A method for resurfacing one or more balls, the method comprising:

(a) placing one or more lacrosse balls into a ball container, the container comprising:

a bottom wall;

a cylindrical side wall having an upper edge portion which includes inner and outer surfaces and a top edge, wherein a top portion of the inner surface of the cylindrical side wall has screw threads thereon; an open top end, the cylindrical side having a diameter between 80 mm and 100 mm;

a cap having a top and bottom surface and a generally cylindrical side wall having an outer surface, the outer surface of the side wall of the cap having screw threads thereon which are engageable with the screw threads of the container;

wherein the inner surface of the cylindrical side wall is an abrasive surface, the abrasive surface is integrally cast or molded to the inner surface and configured to resurface one or more balls;

(b) attaching the cap to the container; and (c) moving the ball container in a reciprocating motion such that movement of the ball container moves the one or more balls within the container wherein the diameter of the cylindrical side enables the one or more balls to strike the abrasive surface thereby resurfacing the ball, wherein the cap has a pressure release hole to ease movement of the one or more balls.

* * * * *